US006929674B1

(12) United States Patent
Ricketts et al.

(10) Patent No.: US 6,929,674 B1
(45) Date of Patent: Aug. 16, 2005

(54) COVER GASES

(75) Inventors: Nigel Jeffrie Ricketts, Forest Lake (AU); Malcolm Timothy Frost, Kenmore Hills (AU); Simon Paul Cashion, St Lucia (AU); Craig John Korn, Springfield (AU); Phillip Wilmott Baker, Indooroopilly (AU)

(73) Assignee: Cast Centre Pty Ltd, (AU)

( * ) Notice: Subject to any disclaimer, the term of this patent is extended or adjusted under 35 U.S.C. 154(b) by 0 days.

(21) Appl. No.: 10/031,813

(22) PCT Filed: Apr. 28, 2000

(86) PCT No.: PCT/AU00/00393

§ 371 (c)(1),
(2), (4) Date: May 28, 2002

(87) PCT Pub. No.: WO00/64614

PCT Pub. Date: Nov. 2, 2000

(30) Foreign Application Priority Data

Apr. 28, 1999 (AU) ..... PQ0015

(51) Int. Cl.[7] ..... C22B 9/05

(52) U.S. Cl. ..... 75/300; 75/602; 75/709; 252/3; 169/44; 169/45

(58) Field of Search ..... 75/585, 709, 300, 75/602; 252/3; 169/43, 44, 45, 46, 47

(56) References Cited

U.S. PATENT DOCUMENTS

| | | | | |
|---|---|---|---|---|
| 1,972,317 | A * | 9/1934 | Reimers | 75/602 |
| 5,115,868 | A * | 5/1992 | Dougherty et al. | 169/45 |
| 5,763,701 | A | 6/1998 | Deger et al. | |
| 6,167,944 | B1 * | 1/2001 | Ricketts et al. | 164/479 |
| 6,537,346 | B2 * | 3/2003 | Milbrath et al. | 75/585 |

FOREIGN PATENT DOCUMENTS

| | | | |
|---|---|---|---|
| DE | 34 25 400 | A | 1/1986 |
| EP | 0 943 700 | A2 | 9/1999 |
| JP | 05 214384 | A | 8/1993 |
| JP | 08 143985 | A | 6/1996 |
| WO | WO 91/02564 | * | 7/1991 |
| WO | WO 96/22129 | * | 7/1996 |

* cited by examiner

*Primary Examiner*—Melvyn Andrews
(74) *Attorney, Agent, or Firm*—Rodman & Rodman

(57) ABSTRACT

A cover gas composition for protecting molten magnesium/magnesium alloy includes a fluorine containing inhibiting agent and a carrier gas. Each component of the composition has a Global Warming Potential (GWP) (referenced to the absolute GWP for carbon dioxide at a time horizon of 100 years) of less than 5000.

27 Claims, No Drawings

COVER GASES

FIELD OF THE INVENTION

The present invention relates to compositions useful as cover gases for protecting molten magnesium/magnesium alloys. The present invention also relates to a method for protecting molten magnesium/magnesium alloys and to a method for extinguishing magnesium/magnesium alloy fires.

BACKGROUND ART

Magnesium is a highly reactive and thermodynamically unstable element. Molten magnesium is readily and violently oxidised in ambient air, burning with a flame temperature of approximately 2820° C. Three approaches have been used to inhibit the severe oxidation process. Salt cover fluxes may be sprinkled over the molten metal; oxygen may be excluded from contacting the molten metal by blanketing the molten metal with an inert gas such as helium, nitrogen or argon; or a protective cover gas composition may be used to blanket the molten metal. Protective cover gas compositions typically comprise air and/or carbon dioxide and a small amount of an inhibiting agent which reacts/interacts with the molten metal to form a film/layer on the molten metal surface which protects it from oxidation. To this day, the mechanism by which inhibiting agents protect molten reactive metals is not well understood.

U.S. Pat. No. 1,972,317 relates to methods for inhibiting the oxidation of readily oxidisable metals, including magnesium and its alloys. The patent notes that at the time of its filing in 1932, numerous solutions had been proposed to the oxidation problem including displacing the atmosphere in contact with the metal with a gas such as nitrogen, carbon dioxide or sulphur dioxide. U.S. Pat. No. 1,972,317 teaches inhibition of oxidation by maintaining in the atmosphere in contact with molten metal an inhibiting gas containing fluorine, either in elemental or combined form. Reference is made to many fluorine containing compounds with the solids ammonium borofluoride, ammonium silicofluoride, ammonium bi-fluoride and ammonium fluophosphate or the gases evolved therefrom upon heating being said to be preferred. Notwithstanding the issue of U.S. Pat. No. 1,972,317 in 1934, it was not until about the mid-1970's that a fluorine containing compound found commercial acceptance as an inhibiting agent in a cover gas.

Prior to about the mid-1970's, sulphur dioxide ($SO_2$) was widely used as an inhibiting agent in a magnesium cover gas composition but was replaced by sulphurhexafluoride ($SF_6$) which has become the industry standard. Typically, $SF_6$ based cover gas compositions contain 0.2–1% by volume $SF_6$ and a carrier gas such as air, carbon dioxide, argon or nitrogen. $SF_6$ has the advantages that it is a colourless, odourless, non-toxic gas which can be used for protecting molten magnesium/magnesium alloy and in the production of bright and shiny ingots with relatively low dross formation. However, SF, suffers from several disadvantages. Its sulphur based decomposition products at high temperature are very toxic. It is expensive, has limited sources of supply, and is one of the worst known greenhouse gases having a Global Warming Potential (GWP) at a time horizon of 100 years of 23,900 relative to 1 for carbon dioxide.

It is also noted that once magnesium has ignited, the resulting fire cannot be extinguished even with high concentrations of $SF_6$. $SO_2$ is even worse in this respect as it can accelerate a magnesium fire. The only known cover gas for extinguishing a magnesium fire is boron trifluoride ($BF_2$) which is very expensive and very toxic.

Alternative cover gas compositions are desirable.

SUMMARY OF THE INVENTION

In a first aspect, the present invention provides a cover gas composition for protecting molten magnesium/magnesium alloy, the composition including a fluorine containing inhibiting agent and a carrier gas, wherein each component of the composition has a Global Warming Potential (GWP) (referenced to the absolute GWP for carbon dioxide at a time horizon of 100 years) of less than 5000.

Preferably, the inhibiting agent has minimal ozone depletion potential, more preferably the inhibiting agent has no ozone depletion potential.

Preferably, the inhibiting agent is non-toxic. In this regard, compounds having a Threshold Limit Value-Time Weighted Average (TLV-TWA) (the time weighted average concentration for a normal 8 hour workday and a 40 hour workweek, to which nearly all workers may be repeatedly exposed, day after day, without adverse effect) as issued by the American Conference of Governmental Industrial Hygienists of less than 100 ppm are considered to be toxic. By way of example, $BF_2$, silicon tetrafluoride ($SiF_4$), nitrogen trifluoride ($NF_3$) and sulfuryl fluoride ($SO_2F_2$) disclosed in U.S. Pat. No. 1,972,317 are toxic.

The composition may include a mixture of inhibiting agents (each having a GWP less than 5000) and preferably comprises a minor amount of inhibiting agent and a major amount of a carrier gas. Preferably, the composition consists of less than 1% by volume inhibiting agent and the balance carrier gas. More preferably, the composition contains less than 0.5% by volume (most preferably less than 0.1% by volume) inhibiting agent.

Preferably, each component of the composition has a GWP of less than 3000, more preferably, less than 1500.

Suitable carrier gases include air, carbon dioxide, argon, nitrogen and mixtures thereof.

The inhibiting agent may be selected from the group consisting of hydrofluorocarbons (HFCs), hydrofluoroethers (HFEs) and mixtures thereof. Preferably, the inhibiting agent has a boiling point of less than 100° C., more preferably less than 80° C. Where the inhibiting agent is gaseous at ambient temperature, it may be diffused in the carrier gas at the desired concentration. Where the inhibiting agent is liquid at ambient temperature, it may be entrained in the carrier gas to a desired concentration by passing a flow of carrier gas over the inhibiting agent. Suitable hydrofluorocarbons and hydrofluoroethers are listed in Table 1 below which includes their boiling points (BP) and their GWP's (referenced to the absolute GWP for carbon dioxide at a time horizon of 100 years) which have been sourced from IPCC 1996.

TABLE 1

| Chemical Name | Industry Name | Formula | GWP | BP |
|---|---|---|---|---|
| difluoromethane | HFC-32 | $CH_2F_2$ | 580 | −52° C. |
| pentafluoroethane | HFC-125 | $C_2HF_5$ | 3,200 | −49° C. |
| 1,1,1,2-tetrafluoroethane | HFC-134a, R134a | $C_2H_2F_4$ | 1,300 | −26° C. |
| difluoroethane | HFC-152a, R152a | $C_2H_4F_2$ | 140 | −27° C. |
| heptafluoropropane | HFC-227ea | $C_3HF_7$ | 2,900 | −17° C. |
| methoxy-nonafluorobutane | HFE-7100 | $C_4F_9OCH_3$ | 480 | 61° C. |
| ethoxy-nonafluorobutane | HFE-7200 | $C_4F_9OC_2H_5$ | 90 | 78° C. |

TABLE 1-continued

| Chemical Name | Industry Name | Formula | GWP | BP |
|---|---|---|---|---|
| dihydrodecafluoropentane | HFC-43-10-mee | $C_5H_2F_{10}$ | 1,300 | 54° C. |

A preferred cover gas composition consists of 1,1,1,2-tetrafluoroethane and dry air. Experimental work has demonstrated that such a cover gas composition provides protection at least the equal of $SF_6$ based compositions and can be utilised at lower concentrations of inhibiting agent. $SF_6$ has a GWP in excess of 18 times that of 1,1,1,2-tetrafluoroethane and is presently more than 2½ times the cost of 1,1,1,2-tetrafluoroethane.

In a second aspect, the present invention provides a method of protecting molten magnesium/magnesium alloy, the method including blanketing the molten magnesium/magnesium alloy with a cover gas composition according to the first aspect of the present invention.

The method according to the second aspect of the present invention is applicable to protecting molten magnesium/magnesium alloy in a foundry vessel such as a furnace and during casting.

In a third aspect, the present invention provides use of an inhibiting agent as defined with respect to the first aspect of the present invention for preventing or minimising oxidation of molten magnesium/magnesium alloy. By way of example, an inhibiting agent of the present invention may be used to prevent or minimise oxidation of molten magnesium/magnesium alloy during sand casting. Where the inhibiting agent is gaseous at ambient temperature, the sand mould may be purged with inhibiting agent prior to pouring of the molten metal. Where the inhibiting agent is liquid at ambient temperature, the sand mould may be sprayed with inhibiting agent from a squeeze bottle or the like prior to pouring of the molten metal. Other suitable methods of using inhibiting agents of the present invention to prevent or minimise oxidation of molten magnesium/magnesium alloy will be readily apparent to those of skill in the art of foundry practice.

In a fourth aspect, the present invention provides a method of extinguishing a magnesium/magnesium alloy fire, the method including exposing the fire to an atmosphere of an inhibiting agent as defined with respect to the first aspect of the present invention. The fire may be so exposed by, for example, subjecting it to a flow of the inhibiting agent or immersing it in a reservoir containing the inhibiting agent.

EXAMPLES

The ensuing non-comparative Examples are illustrative of preferred embodiments of the present invention and are not to be construed as limiting the scope of the present invention in any way.

Example 1

A crucible furnace containing 100 grams of molten pure magnesium at 680° C. was blanketed with a gaseous composition consisting of 0.02% by volume 1,1,1,2-tetrafluoroethane and the balance dry air. Good molten magnesium protection was observed, with the formation of a thin protective surface film. Deliberate rupturing of the surface film did not induce burning of the molten magnesium sample.

Comparative Example 1

Comparative Example 1 was identical to Example 1 with the exception that 1,1,1,2-tetrafluoroethane was replaced by $SF_6$. Good molten magnesium protection was not observed, and the magnesium sample burned rapidly. Adequate protection of the molten magnesium sample was only achieved when the gaseous composition consisted of 0.05% by volume $SF_6$ and the balance dry air. At this concentration of $SF_6$ deliberate rupturing of the surface film resulted in localised burning of the molten magnesium sample.

Example 1 and Comparative Example 1 demonstrate that the inventive cover gas composition provides good protection of molten magnesium at a lower concentration than an $SF_6$ based composition.

Example 2

A series of single ingots of both pure magnesium and magnesium-aluminium alloy AZ91 were cast in an 8 kg ingot mould within a controllable atmosphere chamber. The molten metal was sucked under vacuum into the chamber to fill the ingot mould. When the ingot mould was full, the vacuum was turned off, the chamber was filled with a cover gas composition, and the molten metal was allowed to solidify. In the case of AZ91 alloy the cover gas composition consisted of 0.04% by volume 1,1,1,2-tetrafluoroethane and the balance dry air. The cover gas composition for the pure magnesium casting consisted of 0.1% by volume 1,1,1,2-tetrafluoroethane and the balance dry air.

Single ingots of both pure magnesium and AZ91 alloy were produced free of burning, with bright shiny surface finishes, with very low levels of dross, and with no reaction with boron nitride mould coatings.

Comparative Example 2

Comparative Example 2 was identical to Example 2 with the exception that 1,1,1,2-tetrafluoroethane was replaced by SF which was used at the same concentrations, ie. 0.04% by volume in dry air for AZ91 alloy and 0.1% by volume in dry air for pure magnesium.

The ingots produced in Example 2 had lower levels of dross and had a more attractive surface finish than those produced in Comparative Example 2.

Example 3

A small flow of 1,1,1,2-tetrafluoroethane was continuously metered into a container that is used to collect molten magnesium dross. During transport of the dross from the furnace to the container, the dross contacted the air and ignited. Upon placing the dross into the container, the burning quickly stopped.

Comparative Example 3

Comparative Example 3 was identical to Example 3 with the exception that 1,1,1,2-tetrafluoroethane was replaced by $SF_6$. In this case, the dross continued to burn after being placed into the container.

Example 3 and Comparative Example 3 demonstrate that an inhibiting agent of the present invention is able to suppress the burning of magnesium metal/dross. This enables minimisation of magnesium fume in a working environment and prevention of oxidation of the magnesium metal content in the dross. This would enable dross processing operations to recover valuable magnesium metal content.

Example 4

Ingots of pure magnesium were cast in 8 kg ingot moulds on an industrial-sized ingot casting machine having a controllable atmosphere chamber. The casting machine was operated at a casting rate of 3 tonnes of cast metal per hour with 330 liters per minute dry air and 3.3 liters per minute 1,1,1,2-tetrafluoroethane introduced into the chamber. Ingots were produced free of burning, with bright shiny surface finishes, with very low levels of dross and with no reaction with boron nitride mould coatings.

Comparative Example 4

Comparative Example 4 was identical to Example 4 with the exception that 1,1,1,2-tetrafluoroethane was replaced by $SF_6$ which was used at the same flow rate and at the same concentration in dry air. Ingots produced in Comparative Example 4 exhibited similar properties to those produced in Example 4.

Example 4 and Comparative Example 4 demonstrate that the inventive gas can successfully replace $SF_6$ for industrial scale continuous production of magnesium ingot.

Example 5

A series of single ingots of pure magnesium were cast in an 8 kg ingot mould within a controllable atmosphere chamber. The molten metal was sucked under vacuum into the chamber to fill the ingot mould. When the ingot mould was full, the vacuum was turned off, the chamber was filled with cover gas composition, and the molten metal was allowed to solidify. The cover gas composition was produced by passing 0.5 liters per minute of dry air over 50 ml of the HFE liquid methoxy-nonafluorobutane. The resulting gas phase mixture flowed to the single ingot casting apparatus. Single ingots were produced free of burning, with bright shiny surface finishes, with very low levels of dross and with no reaction with boron nitride mould coatings.

Example 6

A series of single ingots of pure magnesium were cast in an 8 kg ingot mould within a controllable atmosphere chamber. The molten metal was sucked under vacuum into the chamber to fill the ingot mould. When the ingot mould was full, the vacuum was turned off, the chamber was filled with a cover gas composition, and the molten metal was allowed to solidify. The cover gas composition was produced by passing 0.5 liters per minute of dry air over 50 ml of the HFC liquid dihydrodecafluoropentane. The resulting gas phase mixture flowed to the single ingot casting apparatus. Single ingots were produced free of burning, with bright shiny surface finishes, with very low levels of dross and with no reaction with boron nitride mould coatings.

Example 7

A furnace containing 20 kg of molten magnesium at 700° C. was blanketed with a cover gas composition. The cover gas composition was produced by passing 0.6 liters per minute of dry air over 50 ml of the HFE liquid methoxy-nonafluorobutane. The resulting gas phase mixture flowed to the furnace. Good molten magnesium protection was observed, with the formation of a thin protective surface film. Deliberate rupturing of the surface film did not induce burning of the molten magnesium sample.

Example 8

A furnace containing 20 kg of molten magnesium at 700° C. was blanketed with a cover gas composition. The cover gas composition was produced by passing 0.9 liters per minute of dry air over 50 ml of the HFE liquid ethoxy-nonafluorobutane. The resulting gas phase mixture flowed to the furnace. Good molten magnesium protection was observed, with the formation of a thin protective surface film. Deliberate rupturing of the surface film did not induce burning of the molten magnesium sample.

Example 9

A furnace containing 20 kg of molten magnesium at 700° C. was blanketed with a cover gas composition. The cover gas composition was produced by passing 0.9 liters per minute of dry air over 50 ml of the HFC liquid dihydrodecafluoropentane. The resulting gas phase mixture flowed to the furnace. Good molten magnesium protection was observed, with the formation of a thin protective surface film. Deliberate rupturing of the surface film did not induce burning of the molten magnesium sample.

Example 10

A furnace containing 20 kg of molten magnesium at 700° C. was blanketed with a gaseous composition consisting of 0.4% by volume difluoroethane and the balance dry air. Good molten magnesium protection was observed, with the formation of a thin protective surface film. Deliberate rupturing of the surface film did not induce burning of the molten magnesium sample.

Comparative Example 10

Comparative Example 10 was identical to Example 10 with the exception that difluoroethane was replaced by $SF_6$ which was used at the same concentration. Good molten magnesium protection was observed.

Example 10 and Comparative Example 10 demonstrate that an inhibiting agent of the present invention provides equivalent protection of molten magnesium metal compared to $SF_6$.

Example 11

Magnesium squeeze-castings were produced by hand-pouring molten magnesium into the shot sleeve of a vertical injection squeeze casting machine. Prior to pouring the molten magnesium into the shot sleeve, a small volume of pure 1,1,1,2-tetrafluoroethane was introduced into the shot sleeve. This protected the molten magnesium in the shot sleeve and prevented the molten magnesium from burning during the filling of the mould.

Example 12

Various magnesium components were produced using the investment casting technique. Prior to filling the investment casting shell with molten magnesium, the shell was purged with pure 1,1,1,2-tetrafluoroethane. This prevented the magnesium from burning while solidifying inside the shell. Upon cooling, the shell mould was removed. The magnesium casting exhibited a good surface finish.

Example 13

Various magnesium components were produced using the sand casting technique. Prior to filling the sand mould with molten magnesium, the sand mould was purged with pure 1,1,1,2-tetrafluoroethane. This prevented the magnesium from burning while solidifying inside the sand mould. Upon cooling, the sand mould was removed. The magnesium casting exhibited a good surface finish.

Example 14

A melt furnace having a diameter of 1.6 meters and containing 4 tonnes of molten pure magnesium was blanketed with 60 liters per minute dry air and 0.6 liters per minute 1,1,1,2-tetrafluoroethane. Good molten magnesium protection was observed, with the formation of a thin protective surface film.

Comparative Example 14

Comparative Example 14 was identical to Example 14 with the exception that 1,1,1,2-tetrafluorethane was replaced by $SF_6$ at differing flow rates. The flow rate of dry air was maintained at 60 liters per minute. Good molten magnesium protection was only achieved at an $SF_6$ flow rate of 2 liters per minute.

Example 14 and Comparative Example 14 demonstrate that the inventive cover gas composition provides good industrial scale protection of molten magnesium at a lower concentration than an $SF_6$ based composition.

What is claimed is:

1. A cover gas composition for the protection of molten magnesium/magnesium alloy from oxidation, consisting of a fluorine containing inhibiting agent in an effective amount to inhibit the oxidation of the molten magnesium/magnesium alloy, selected from the group consisting of difluoromethane, pentafluoroethane, 1,1,1,2-tetrafluoroethane, difluoroethane, heptafluoropropane, dihydrodecafluoropentane, hydrofluoroethers and mixtures thereof, and a carrier gas, wherein each component of the composition has a Global Warming Potential (GWP) (referenced to the absolute GWP for carbon dioxide at a time horizon of 100 years) of less than 5000.

2. A composition as claimed in claim 1, wherein the inhibiting agent has no ozone depletion potential.

3. A composition as claimed in claim 1, wherein the carrier gas is selected from the group consisting of air, carbon dioxide, argon, nitrogen and mixtures thereof.

4. A composition as claimed in claim 1, wherein each component of the composition has GWP of less than 3000.

5. The composition of claim 1, wherein the amount of fluorine containing inhibiting agent in the cover gas composition varies from the minimum amount effective to inhibit the oxidation of the molten magnesium/magnesium alloy up to less than 1% by volume of the cover gas composition.

6. A composition as claimed in claim 1 wherein the inhibiting agent has a boiling point of less than 100° C.

7. A composition as claimed in claim 1, wherein the hydrofluoroethers are selected from the group consisting of methoxy-nonafluorobutane, ethoxy-nonafluorobutane, and mixtures thereof.

8. A composition as claimed in claim 4 wherein each component of the composition has a GWP of less than 1500.

9. A composition as claimed in claim 7 wherein the inhibiting agent is 1,1,1,2-tetrafluoroethane and the carrier gas is dry air.

10. A composition as claimed in claim 1, wherein the inhibiting agent is selected from the group consisting of difluoromethane, pentafluoroethane, 1,1,1,2-tetrafluoroethane, difluoroethane, heptafluoropropane, dihydrodecafluoropentane, and mixtures thereof.

11. A composition as claimed in claim 1 containing up to less than 0.5% by volume inhibiting agent.

12. A composition as claimed in claim 11, containing up to less than 0.1% by volume inhibiting agent.

13. A composition as claimed in claim 7, wherein the inhibiting agent is 1,1,1,2-tetrafluoroethane and the carrier gas is selected from the group consisting of nitrogen, carbon dioxide and mixtures thereof.

14. A method of protecting molten magnesium/magnesium alloy from oxidation, comprising blanketing the magnesium/magnesium alloy with a cover gas composition consisting of a fluorine containing inhibiting agent in an effective amount to inhibit the oxidation of the molten magnesium/magnesium alloy, selected from the group consisting of difluoromethane, pentafluoroethane, 1,1,1,2-tetrafluoroethane, difluoroethane, heptafluoropropane, dihydrodecafluoropentane, hydrofluoroethers, and mixtures thereof, and a carrier gas, wherein each component of the composition has a Global Warming Potential (GWP) (referenced to the absolute GWP for carbon dioxide at a time horizon of 100 years) of less than 5000.

15. A method as claimed in claim 14, wherein the inhibiting agent is 1,1,1,2-tetrafluoroethane.

16. A method as claimed in claim 14, wherein said fluorine containing inhibiting agent is a hydrofluoroether.

17. A method as claimed in claim 16, wherein said hydrofluoroether is selected from the group consisting of methoxynonafluorobutane, ethoxynonafluorobutane, and mixtures thereof.

18. A method as claimed in claim 14, wherein said carrier gas is selected from the group consisting of air, $CO_2$, argon, nitrogen, and mixtures thereof.

19. The method of claim 14, wherein the amount of fluorine containing inhibiting agent in the cover gas composition varies from the minimum amount effective to inhibit the oxidation of the molten magnesium/magnesium alloy up to less than 1% by volume of the cover gas composition.

20. A method as claimed in claim 14, wherein the inhibiting agent is selected from the group consisting of difluoromethane, pentafluoroethane, 1,1,1,2-tetrafluoroethane, difluoroethane, heptafluoropropane, dihydrodecafluoropentane, and mixtures thereof.

21. A method for protecting an exposed surface of molten magnesium/magnesium alloy from oxidation in ambient air, comprising: contacting the exposed surface of the molten magnesium/magnesium alloy with a gaseous mixture consisting of a fluorine containing inhibiting agent in an effective amount to inhibit the oxidation of the molten magnesium/magnesium alloy, selected from the group consisting of difluoromethane, pentafluoroethane, 1,1,1,2-tetrafluoroethane, difluoroethane, heptafluoropropane, dihydrodecafluoropentane, hydrofluoroethers, and mixtures thereof, and a carrier gas to form a protective film/layer on the surface of said molten magnesium/magnesium alloy.

22. A method as claimed in claim 21, wherein said carrier gas is selected from the group consisting of air, $CO_2$, argon, nitrogen, and mixtures thereof.

23. A method as claimed in claim 21, wherein the inhibiting agent is 1,1,1,2-tetrafluoroethane.

24. A method as claimed in claim 21, wherein said fluorine containing inhibiting agent is a hydrofluoroether.

25. A method as claimed in claim 24, wherein said hydrofluoroether is selected from the group consisting of methoxynonafluorobutane, ethoxynonafluorobutane, and mixtures thereof.

26. The method of claim 21, wherein the amount of fluorine containing inhibiting agent in the cover gas composition varies from the minimum amount effective to inhibit the oxidation of the molten magnesium/magnesium alloy up to less than 1% by volume of the cover gas composition.

27. A method as claimed in claim 21, wherein the inhibiting agent is selected from the group consisting of difluoromethane, pentafluoroethane, 1,1,1,2-tetrafluoroethane, difluoroethane, heptafluoropropane, dihydrodecafluoropentane, and mixtures thereof.

* * * * *